United States Patent [19]

Mallari

[11] Patent Number: 4,797,197

[45] Date of Patent: Jan. 10, 1989

[54] DELAYED COKING PROCESS

[76] Inventor: Renato M. Mallari, 6403 Teal Run Dr., Houston, Tex. 77035

[21] Appl. No.: 816,366

[22] Filed: Jan. 6, 1986

Related U.S. Application Data

[63] Continuation of Ser. No. 699,417, Feb. 7, 1985, abandoned.

[51] Int. Cl.[4] ..... C10G 9/14

[52] U.S. Cl. ..... 208/131; 208/50

[58] Field of Search ..... 208/131, 50

[56] References Cited

U.S. PATENT DOCUMENTS

| | | | |
|---|---|---|---|
| 2,380,713 | 7/1945 | Wilson | 208/131 |
| 3,687,840 | 8/1972 | Sze et al. | 208/131 |
| 3,956,101 | 5/1976 | Hara et al. | 208/131 |
| 4,199,434 | 4/1980 | Sze et al. | 208/50 |
| 4,267,031 | 5/1981 | Hirabayashi et al. | 208/131 |
| 4,312,742 | 1/1982 | Hayashi | 208/131 |
| 4,312,745 | 1/1982 | Hsu et al. | 208/131 |
| 4,404,092 | 9/1983 | Audeh et al. | 208/131 |

*Primary Examiner*—Anthony McFarlane

[57] ABSTRACT

The impediments of the prior art of delayed coking to enhanced hydrocarbons and minimum coke yields by way of pressure, temperature and recycle ratio have been minimized through the use of an interim drum between the heater and the coke drum, called in this invention as the flasher drum, whereby the heater effluent's vapor is separated from its liquid portion which serves as the feed to the coke drum. The vapor from the flasher and coke drums are hence combined and fed to the fractionator for separation of products. This process of separating the coke drum and flasher drum vapors effects the control of hydrocarbon partial pressure and therefore the subsequent controlled vaporization of the heavy hydrocarbons in the coke drum which would otherwise react extensively in repetitive fashion to produce more coke than necessary. Additional heat is furnished to the liquid portion of the flasher drum by way of the various combinations of prescribed rates of hydrogen gas, steam and fuel gas, heated within the same coker heater in a separate coil or through a separate heater. The injection of hydrogen gas for the traditional case of delayed coking accomplishes only a very mild form of hydropyrolysis reaction and moreover, to replenish only the portion which has been lost by flashing in the flasher drum. A more moderate case of hydropyrolysis is possible in the flasher drum by operating at higher hydrogen partial pressure, higher hydrogen comsumption, higher temperature and higher residence time.

12 Claims, 1 Drawing Sheet

DELAYED COKING PROCESS

This is a continuation of application Ser. No. 699,417, filed Feb. 7, 1985, now abandoned.

FIELD OF THE INVENTION

This invention relates to delayed coking of heavy petroleum residues and more particularly to a new process of increasing the yield of hydrocarbons and minimizing the yield of lower value coke.

BACKGROUND OF THE INVENTION

Delayed coking is a process by which a petroleum derived virgin or cracked residue or any mineral oil characterized by the predominant abundance of carbon and relatively minor amount of hydrogen atom within the compound's chemical structure, is rapidly heated in a prescribed manner at temperatures sufficient to start scission of such chemical bondage and therefrom fed to a vessel large enough to soak or reside for long periods of time. Such soaking in the so called coke drums effects the production of more valuable gases and lighter hydrocarbons, the hydrogen atoms of which are considerably increased at the expense of the co-product coke.

The gases and hydrocarbon liquid produced are analogous to those commonly seen in petroleum refineries, but the coke produced assumes two main classifications which are highly related to the aromaticity and quality of the feedstock residue. On the one hand, feedstocks that are less aromatic or more paraffinic produce coke whose crystallinic structure are fragmented and when calcined does not have a lustrous appearance. It is amorphous and with isotropic properties unsuitable for making high grade graphitized electrodes. Coke with more undesirable sulfur and metals in this class are normally used for fuel.

On the other hand, calcined premium coke produced from thermally cracked residues which are highly aromatic exhibits more crystalline structure, is characterized by its acicular or needle structure and with non-isotropic properties suitable for making high grade graphitized electrodes.

In the usual application of delayed coking the preheated stream of petroleum residue fresh feed is combined with the recycle stream produced from the fractionator bottom section and hence the combined charge is heated at prescribed controlled flow to the coker heater. The heater effluent at controlled temperature sufficient for coking reactions is fed to the coke drum, whereupon in a delayed manner, the heated mass is allowed to react further by thermal decomposition producing hydrocarbons, gases and coke. At the end of the usual 24 hours cycle, the heated mass is switched to the other coke drum for continuity of coking reaction. The previously coke filled drum is henced cooled at a prescribed schedule and decoked hydraulically in a manner well-known to those skilled in the art. The coke drum overhead vapors consisting of of the net product gases, hydrocarbons and the recycle stream enter the fractionator where various hydrocarbon products are separated and delivered to other downstream equipment for further separation and processing. The heavier recycle stream cut is separated from the heavy gas oil product via the process of reflux condensation or fractionation in the section below the first heavy gas oil product draw tray. It is henced combined with the fresh feed for reprocessing in the heater and coke drums.

The main function of the heater is to provide heat for the endothermic coking reaction and due to the high temperature requirement at the outlet condition of 920° F. or thereabouts, the heated mass itself has undergone simultaneous vaporization and thermal decomposition in the heater tubes which can be compared to a visbreaker unit operation on account of its analogy with regards to temperature, residence time and %hydrocarbon conversion, which for example, are shown below:

| Type of Unit | Residence Time, min. | Heater Outlet Temp., °F. | % Conversion (to light oil EP) |
|---|---|---|---|
| Visbreaker, coil type | 1.0 | 905. | 14.4% |
| Visbreaker, soaker type | 4.0 | 851. | 14.4% |
| Coker heater | 0.5 | 920. | 17.6% |

By virtue of its high conversion the coker heater's liquid effluent is thermally unstable, asphaltenes are formed and well on its way to further polycyclic condensation to pitch formation. The vapors of approximately 28% of the total heater effluent mass consist of the same vapor components as the coke drum overhead up to the light gas oil components; plus, a minor amounts of the heavy gas oil and recycle stream cuts.

Pressure at the heater outlet is virtually controlled in the coke drum which in turn is monitored and controlled in the coker fractionator overhead receiver. This variable is hence limited and can not be liberally altered without affecting the operability of the process. The other controlled variable in this equipment is the heater outlet temperature which is in the usual manner is in the range of 900° to 940° F. Low temperature yields less hydrocarbons, produces a soft coke or pitch-like coke characterized by unacceptably high volatile carbonaceous matter content (VCM content), produces thermally unstable heavy hydrocarbons which eventually ends up in the heater tubes via the recycle stream (thus, promoting premature heater tube coke deposits) and the problematic tendency in the coke drums to foam more than the controllable amount. High temperature yields more hydrocarbons, produces a hard coke of low VCM content and the problematic tendency of the fluid, consisting mainly of the overheated unstable heavy petroleum residue to deposit coke in the tubewall which eventually builds up to a point that fluid flow is seriously impeded. Coke deposits tend to overheat the tubes which eventually become the overriding factor in shutting down the coker unit. Tubewall coke deposit however is routinely handled in a delayed coking process. With proper combination of fluid velocity, outlet temperature, crackability of feedstock, diluent addition and steam injection, the interval period between steam-air decoking well known to those skilled in the art can be at least one year. The most common cause of tubewall coke deposit normally observed in this heater can be traced to the laminar film of heavy crackable liquid coating the tubewall and aggravated by high film temperature due to very low heat film transfer coefficient. Such film is avoided by high fluid velocity and liquid dilution. Velocity is achieved by deliberately operating at no less than 5.0 feet per second inlet cold oil velocity (COV), but preferably more than 6.0 feet per second and typically augmented by steam injection. Dilution is provided by more recycled material and possibly the addition of non-crackable paraffinic lighter hydrocarbons in the fresh feed. Dilution also provides the opportunity for the minute size asphaltene particles to be released from the tubewall and become part of the fluid in the turbulent region. Steam injection on the other hand, by virtue of its lighter density, would tend to concentrate in the center of the tube for certain flow conditions and hence effecting a heavy liquid velocity much lower than the average fluid velocity. More vaporization effected by more steam injection would not help a severely coking tube with very low inlet COV. A unique case of premature tube coking is a very low heater outlet temperature which eventually produces a thermally unstable heavy hydrocarbon vapor in the coke drum and ends up in the heater tubes via the recycle stream.

At the heater outlet temperature typically above 920° F. to as much as 940° F., the heavy gas oil and recycle cuts, considered more refractory than the cracked virgin residue, would partially vaporize and leaving in the fluid more thermally unstable liquid residue. The dilution effect of such materials are diminished and hence the coking tendency in tubes. For a usual outlet pressure of 50 psig, paraffinic stocks are seldom observed at 950° F. Aromatic stocks which are considered more refractory are sometimes operated at more than 950° F.

To minimize coke deposit in the heater transfer line the effluent is transported rapidly to the coke drum within 5 to 10 seconds and a fluid velocity no less than 35 per second but preferably as close to 65 feet per second. Fluid temperature decreases 15° to 25° F. indicating reaction is actually taking place in such line. The highly unstable liquid portion decomposes to pitch-like carbonaceous material upon entry into the coke drum in approximately 20 minutes and the solid, spongy looking product coke, as is well known in the art, is finally produced after soaking for more than 3 hours.

The reaction mechanism in the coke drum is analogous to that in the heater which namely, thermal decomposition and subsequent combination of formed radicals by the the process of dehydrogenation. with declining temperature and readily available reactants in the liquid phase the radical bonding may be repeated extensively over a period as long as 24 hours forming coke characterized by its highly carbonaceous structure. The vapors produced in the heater are thermally stable and simply passes through the coke bed, uncracked, and hence mixes with the vapors produced in the coke drum itself.

The endothermic coking reactions, vaporization of liquid hydrocarbons and heat losses utilize the sensible heat available from the incoming heater effluent resulting to a substantial reduction in temperature. The vapors driven off the reacting liquid mass are at a temperature corresponding to their dew point temperature at a total pressure imposed by dynamic pressure losses and absolute pressure controlled on the fractionator overhead receiver. Every delayed coker unit with a given set of operating conditions and feedstock properties is observed to established a definite but limited relationship of heater outlet and coke drum vapor temperature in the range of 90° to 135° F. difference, more typically, 100° F.

It is interesting to note that for the same heater outlet temperature, such difference in temperature decreases, or hence the coke drum overhead vapor temperature increases, with corresponding increase in the quantity of recycle material which clearly indicates an excess of heat has been made available in the total coke drum feed material. Such vapor is subsequently quenched in the overhead line to suppress further coke formation. In order to effectively avoid excessive and problematic coke deposit in the overhead line and valves, this quenched temperature is maintained at about 780° to 800° F. The quenched vapor material enters the fractionator where the recycle stream is produced by the process of condensation or fractionation in the tower section below the first heavy gas oil draw tray which also effectively cleanses off the coke carryover particles and controls the end boiling point of the heavy gas oil product. The total recycle material consisting of the condensed material produced by the process of quenching and fractionation or condensation combines with the fresh feed petroleum residue in the fractionator bottoms and hence charged to the heater. The quotient of the recycle of fresh feed is commonly called in the art as the "recycle ratio" or for convenience, the quotient of the heater charge to fresh feed on a volumetric basis is hereinafter called "total feed ratio" (TFR). For clarity, for example, a 0.10 recycle ratio is the equivalent of 1.10 TFR.

At 1.10 TFR the initial 5% boiling range of the recycle material is approximately 790° F. to 830° F. and about 690° to 790° F. for an equivalent 1.25 TFR. Such boiling range is vaporized in the heater outlet up to approximately 830° F. cut point. Hence, at 1.10 TFR about 5% of the recycle material and about 10% at 1.25 TFR are the vaporized portion of the recycle in the heater outlet at the pressure prevalent in the art of approximately 50 psig.

The liquid portion of the recycle material enters the coke drum bottom, vaporizes further and therefrom undergoes thermal scission and extensive coking reactions along with the fresh feed material producing the gases, coke and hydrocarbons; plus, the freshly made recycle material with a boiling point range above the heavy gas oil. The quantity of the liquid portion of the recycle which actually undergoes thermal cracking in the coke drum is not measurable, but its effect on the coke yield is well known by those skilled in the art.

For a given coke drum pressure and heater outlet or coke drum vapor temperature, an increase in TFR increases the coke yield almost linearly up to a value of 1.30 TFR and hence becomes insignificant at 1.50 TFR and thereafter. The heavy gas oil returned to the heater as recycle, during very high recycle rates, is predominantly light gas oils that have been exposed many times to thermal cracking reactions and hence becomes insensitive to coking conditions and furthermore, said gas oils have a boiling range below 830° F. which is readily vaporized in the heater outlet. The contribution of the recycle material to the coke yield can be as much as 7.0 to 11.0 weight% of the fresh feed at 2.0 TFR; 5.5 to 7.0% at 1.5 TFR; 4.0 to 5.0% at 1.25 TFR; 2.5 to 3.5% at 1.05 TFR; and, 0.0% TFR—the lower ranges of which are realized at lower pressure and higher temperature, typically below 25 psig and above 920° F. heater outlet temperature.

For the same recycle ratio and temperature, coke yield decreases with decreasing pressure since more hydrocarbons are vaporized at lower operating pressure. Operation at lower pressure however would lower vapor density in the coke drum as well as in the fractionator, necessitating an increase in diameter of said equipment if the same velocity is maintained. Moreover, the fractionator overhead compressor capacity would have to be increased for the corresponding decrease in inlet pressure. The choice therefore for the design pressure is purely the economical viability of operating at lower pressure and increased hydrocarbon yield for more investment in additional equipment capacity. The choice in pressure above the coke bed is usually between 10 to 50 psig for the case of making fuel grade coke and as much as 100 psig for the case of making high grade preminum coke; more typically, 12 to 35 psig for the former case and 50 to 75 psig for the latter case, with a corresponding decrease in coke yield of approximately 1.0 to 2.0%—the higher range of which are realized at lower recycle and higher heater outlet temperature.

For the same recycle ratio and drum pressure, coke yield decreases with increasing furnace outlet temperature since more hydrocarbons are vaporized and hence unavailable for further coking reaction. The furnace temperature is constrained over a narrow range by several operating variables. On the lowest end of the range, this temperature is determined by uncontrollable foaming in the coke drum or highly unstable heavy hydrocarbons which tend to prematurely deposit coke in the heater tubes or it produces soft coke or pitch-like material with unacceptably high VCM content. On the highest end of the range, this temperature is determined by low VCM content commonly associated with the coke hardness or the unacceptably longer hydraulic jet decoking period required to remove coke inside the cold drum or the coking tendency inside the heater tube due to overcracking and diminished dilution due to over vaporization of the fluid at the heater outlet. The choice of temperature is determined during operation when all the interaction of all variables are known for the charge stock on hand. For more aromatic stocks, the range is higher at about 935° F. to 960° F. and lower for paraffinic stocks, typically at 910° to 940° F. The high range are seldom exceeded due to the aforementioned constraints, but more particularly due to excessive heater tube coke deposit and very hard coke in the drum. A 30° F. rise in temperature corresponds to approximately 2.0 to 4.0% decrease in coke yield—the higher range of which are realized at lower recycle ratio and lower pressure.

Stocks of high boiling virgin or cracked petroleum residue are used for coking operations which may be suitable for blending to heavy fuel oil such as fuel oil no. 6. Delayed coking, along with other heavy petroleum residue processes reduce heavy fuel oil inventory and are normally justified since the price of fuel oil is substantially lower than the combined prices of the more valuable products. Pricing of fuel oil however is erratic and during times of market upswing, this price differential has diminished to a point that some existing cokers in the current state of the art can not operate at a profit and moreover, a new unit may not be justified economically. But with the advent of much heavier future crude stocks of higher metals, sulfur and other impurities of varying and unpredictable properties, delayed coking is still competitive. With the possibility of crowded market for fuel grade coke, the demand for an improved delayed coking process featuring a substantial decrease of coke yield and enhanced hydrocarbon yield has never been as pronounced. In addition, due to changing petroluem products market demand, supply and prices, not to mention the poor quality of crude stocks, it is almost imperative to have a delayed coking process with plenty of operating and design flexibilities. This invention accomplishes these objectives and also compliments other innovations for hydrocarbon yield enhancement.

The process of introducing an interim drum between the heater and the coke drums may be compared to another thermal craking process called "visbreaking". In one configuration of this process, a so called "soaker drum" between the heater and the fractionator is introduced to operate the heater at lower temperature than the conventional "coil" type visbreaking process, without an interim drum. The same conversion and slightly different product distribution are accomplished in the soaker type process by careful manipulation of residence time and heater outlet temperature. It should be noted that visbreaking is quite analogous to delayed coking without the coke drums. The former's heater effluent is its product, while the latter's heater effluent is fed to the coke drum for further thermal treatment.

Said interim drum in this invention is hereinafter called the "flasher drum". In its basic configuration shown in FIG. 1, the heater effluent vapor is separated from the liquid portion used as the only feed to the coke drum. Such vapor, present in the coke drum in the prior art, exerts a partial pressure which suppresses vaporization of liquid hydrocarbons. The absence of such vapor in the coke drum in this invention induces more hydrocarbons to vaporize and hence avoid further thermal coking reaction leading to enhanced hydrocarbon yield and minimum coke make. The introduction of the flasher drum also affords higher heater outlet temperature at high recycle ratio, accommodate further addition of heat and since the vapor portion of the recycle is separated from the flasher drum, the liquid portion of the recycle fed with the fresh feed into the coke drum is of consistently higher boiling point range corresponding to a lower TFR than the original TFR charged into the heater. Hence the significant effect of high TFR to coke yield is minimized. The introduction of heated gases and more particularly, hydrogen gases at varying rates into the flasher drum affords further flexibility in this invention. This process, commonly referred to as hydropyrolysis, is the reaction of hydrogen gas with the thermally cracked hydrocarbon radicals in the absence of a catalyst making a very stable hydrocarbon compound incapable of further bimolecular reaction with another radical. This reaction is the reverse of coking reaction and hence minimizes coke production.

Hydropyrolysis have been investigated solely for the purpose of competing directly with delayed coking process and none has fully appreciated the possibility of intermingling its good points for the enhancement of hydrocarbon yield and substantial coke yield reduction. For example, Bunger, et al., (ACS Symposium Series 163, 1981, pp. 369–380) disclosed in his research at the University of Utah that complete hyropyrolysis of heavy crudes without the formation of coke is possible in a reactor-heater coil at high temperature, high hydrogen partial pressure and high hydrogen consumption with as little as one minute residence time.

A mild form of hydropyrolsis is also disclosed in Hayashi's U.S. Pat. Np. 4,132,742 to refine or remove problematic impurities in the petroleum residue.

The common denominator and basic principle underlying this invention and that the prior art's yield enhancement techniques is the vaporization of liquid hydrocarbons in the coking mass, whereby, further polymerization of hydrocarbon radicals is effectively minimized at varying degrees. This is also true in most recent inventions accomplishing the same objective which is also compatible with this invention as well as the prior art. For example, U.S. Pat. No. 4,358,366 discloses the injection of hydrocracking catalyst and hydrogen gas to coke drum improves hydrocarbon yield and reduces coke make. U.S. Pat. No. 4,378,288 claim increase coker distillate yield by adding a small amount of a free radical inhibitor consisting of hydroquinone and N-phenyl-2-naphylamine to the coker feed material. Similarly, U.S. Pat. No. 4,399,024 teach the promotion of rapid liquid hydrocarbon vaporization by addition of one of the prescribed additives, consisting of metal salts of dialkyxanthogenic acids and others. The reaction explained being the stabization of free radicals formed during the thermal scission process typically observed in delayed coking.

SUMMARY OF THE INVENTION

The restrictions of the prior art of delayed coking with regard to hydrocarbon yield enhancement by way of pressure, temperature and recycle ratio have been minimized by this invention through the use of an interim drum between the heater and the coke drum, so called herein as the "flasher drum", whereby the heater effluent's vapor is separated from its liquid portion effecting the subsequent substantial reduction of coke production. Additional heat is furnished to the liquid portion in the flasher drum by way of the various combinations of prescribed rates of hydrogen, steam and fuel gas, heated within the same coker heater in separate coils. Hydrogen injection for the traditional case of delayed coking accomplishes only a very mild form of hydropyrolysis reaction in the flasher drum and moreover, to replenish only that which has been lost by flashing. A more moderate case of hydropyrolysis is also possible in this flasher drum by operating at higher hydrogen partial pressure, higher hydrogen consumption and higher temperature provided by an outside heater other than the traditional coker heater.

DETAILED DESCRIPTION OF THE INVENTION

There are two ways of operating the heater with the flasher drum. In one case, it can be operated at low heater outlet pressure and temperature as is common in the prior art, typically 50 psig and 920° F. This operation is expected towards the end-of-run condition in the heater tubes whereby it is so fouled, about 100 psi more pressure is necessary to push the same throughput. In the other case, it can be operated at high outlet pressure and temperature range of 75 to 350 psig and 915° to 970° F.; but preferably, for compatibility with the prior art operation, an outlet pressure of 100 to 250 psig and an outlet temperature of 925° to 940° F. for paraffinic stocks, or 935° to 960° F. for aromatic stocks; but no more than 950° to 970° F., nor less than 915° and 925° F., respectively.

Operation at high outlet temperature is restricted only by the coking tendency in the tubes (restrictions of coke hardness or low VCM is controlled in the flasher drum). Coking tendency may be alleviated by injecting steam but has a major drawback of concentrating in the center of the tube by virtue of its low density and hence, its inability to impart at times, a pseudo homogenous two-phase flow condition necessary to release the asphaltenes along the hot tubewall. On the other hand, dilution, as a means of minimizing coking tendency, by way of more recycle or possibly the addition of thermally stable light hydrocarbons, by virtue of its higher vapor density than steam at conditions of high pressure and temperature near its critical pressure, approaches that of the liquid and hence, insuring a pseudo homogeneous two-phase flow condition necessary to release said asphaltenes from the tubewall. Said mechanism of dilution furthermore, increases the film transfer coefficient by substantial reduction of viscosity in the laminar film region and thereby substantially decrease the film temperature which would otherwise be so hot (as imparted by the hot firebox temperature when turbulent flow condition is not satisfied). The properties of the petroleum residue with regard to its cracking tendency has also a controlling effect to coking in the tubes. Heavy paraffinic stocks, typically of less than 9.0° API and 1,050° F. TBP cut point is seldom operated at more than 930° F. at 1.10 to 1.20 TFR; whereas, lighter paraffinic and aromatic stocks are routinely operated at more than 930° F. It is in the former's operation in which this invention is very well adaptable because the unit can run as much recycle as economically feasible since a substantial portion of this material is separated in the flasher drum and would have minimal effect to the hydrocarbon and coke yields. Furthermore, only a small portion of the recycle material, below a cut point of 830° F. is vaporized in the tubes and hence, its remaining liquid portion, after mixing with the liquid portion of the petroleum residue, decreases the cracking reaction rate of the mixture. In addition, more recycle increases the liquid velocity in the tubes and in so doing, decreases the liquid resistance time leading to lesser degree of conversion of the problematic tarry-like asphaltene residue.

At the higher outlet temperature as specified in the aforementioned discussion, a higher recycle flowrate equivalent to at least 1.20 but no more than 1.40 TFR; preferably, 1.30 TFR and an inlet cold oil velocity (COV) of no less than 6.0 feet per second up to 8.0 fps, preferably, more than 7.0 fps are specified. The absence of steam injection decreases tube pressure drop and hence accomodates the increase in COV specification.

Operation at higher heater outlet pressure than the prior art, and therefore in the flasher drum as well, increses the reaction rate of decomposition of the petroleum residue, but between the ranges of operating pressure specified, said reaction rate has been known in the art as relatively insignificant. Its main effect is mainly the suppression of liquid vaporization-making it more necessary to operate at higher inlet COV for lower equivalent residence time. In addition, the products from operating at the traditional low pressure of the prior art are mainly the problematic production of tarry residues. In order to mainly produce gasoline, the pressure must be sufficiently high to keep all materials, other than, kerosene and gas, in the liquid phase. But in order to increase the hydrocarbon yield, the gas oils portion of the recycle should also vaporize. Hence, the correct pressure in the flasher drum is a compromised value which must be established during operation when all interacting variables are known.

In the flasher drum, the heater effluent's vapor and liquid are separated and the liquid therein, provided with a maximum of 10 minutes residence time settles in the bottom of the drum, and is provided with additional heat (for its continuing endothermic reaction) with a combination of steam, hydrogen-rich gas refinery full gas and light hydrocarbons at 970° to 1,150° F., and at a combined rate such that said liquid, after being properly mixed with the heating gases, would not have a temperature much higher than when it entered into the vessel; and preferably, not within 15° F. of the coke drum maximum operating temperature. Entrance of the fluid into the vessel is preferably in a tangential manner in such a way as to impart a swirling motion on the separated vapor mass and hence, carrying along with it the quench oil spray used to stop the continuation of coking reaction in the vapor. The quantity of said quench oil, derived from the coker light oils, preferably, of less than 650° F. end boiling point, is such that the quenched vapor line temperature is no more than 840° F., but no less than 780° F.

The coke drum injection gas, derived from a small portion of the separated vapors, exits the flasher drum and therewith mixed with the liquid bottoms, immediately downstream of the vessel liquid control valve, increases fluid velocity in the coke drum inlet line and minimizes coke deposition by hydrogen suppression; but particularly, to impart gas percolation through the coke bed equivalent to the prior art process of producing porous or spongy-like appearance solid coke and most importantly, to provide enough heat to the coke drum overhead vapors such that its temperature is no less than 785° F. In addition, the flowrate of said injection vapor is to be controlled for greater hydrocarbon yield in the coke drum, but no more than what is required to leave a minimum of 4 to 6% VCM, preferably, 6 to 8%, in the green coke product. The actual operational flow is dependent on the coke drum overhead temperature relationship with the desired % VCM as well as the most desirable coke bed hardness and quality established for each class of petroleum residue feedstock.

For the traditional case of delayed coking operation, heated hydrogen gas is injected into the vessel bottoms liquid primarily to stabilize the gas oil radicals which may otherwise become a problem in the continuous and coke free operation of the heater; but most importantly, to stabilize the flasher drum liquid which would otherwise become so reactive, under conditions of high temperature and considerable time, as to induce polycyclic aromatic polymerization of formed bimolecular radicals, and final form of which is the problematic tarry to pitch-like residues with known tendencies to plug up the equipment to the point of prematurely rendering the flasher drum unoperational. The conditions in the flasher drum lend itself only to the mildest form of hydropyrolysis for the traditional case of delayed coking operation. Its flowrate, along with the other heating gases, are limited to the prior art's fractionator and compressor typical capacities; but may be increased if dictated by economical operation for higher investment, the payout being the increased hydrocarbon yield as induced by higher temperature and improved hydropyrolysis reaction. The following flow limits, for demonstration purposes, have been estimated as a minimum for the traditional case of delayed coking capacities; but may be raised to maximize vapor product generation without causing premature coking in the vessel, without exceeding the optimum capacities of the fractionator or overhead compressor and without exceeding the maximum operating temperature of the vessel and the coke drums.

| | Unit per Barrel of Heater Charge | |
|---|---|---|
| 1. Hydrogen rich gas | 5.6 Scf $H_2$ | (100% basis) |
| 2. Refinery Fuel gas | 55.3 Scf | (20% of net total produced) |

-continued

| | Unit per Barrel of Heater Charge | |
|---|---|---|
| 3. Superheated steam | 3.6 Lbs | (fractionator limiting) |

Additional vaporization of hydrocarbons, made possible by the excess sensible heat in the heating gases, is assisted further by the inherent oil stripping or carrying capability made available by the medium provided by these gases. Hence the net result of the flashing, vaporizing, reacting and mixing operations in the flasher drum are to produce a resultant liquid bottoms with more thermally reacted heavy hydrocarbons (e.g., 650° F.+ boiling point residue) than the heater effluent liquid; and to produce a resultant vapor with more gaseous constituents (combination of heating gases and products of reactions consisting of hydrogen, hydrogen sulfide and gaseous hydrocarbons such as methane, ethane, ethylene, ethane, propylene, propane, isobutane, n-butane and 1 butene), more thermally converted light hydrocarbons (pentane and gasoline end point), and more vaporized hydrocarbons (C5+; combination of unreacted hydrocarbons and products of reactions exclusive of light hydrocarbons) than the heater effluent vapor. Such reactions consist mainly of: the thermal cracking of heavy hydrocarbons in the separated heater effluent liquid into light hydrocarbons, gases, and gaseous hydrocarbons; the recombination of formed hydrocarbon radicals into heavier or higher molecular weight or higher boiling point hydrocarbons; and the polymerization of aromatic hydrocarbons into even heavier hydrocarbons (formation of more condensed polyaromatic hydrocarbons or transformation to intermediate stage coking reactions). Controlled injection of heating gases, particularly with hydrogen-rich gas, reduces polymerization reactions while promoting thermal cracking and recombination reactions. Polymarization reactions are more pronounced without the heating gases, but can be reduced with shorter residence time, higher operating pressure and lower operating temperature. In either case, excessive vaporization will promote more extensive polymerization reactions.

Moderate hydropyrolysis may be effected through the flasher drum under conditions of high hydrogen partial pressure of as much as 1,200 psig, hydrogen consumption of as much as 1,000 scf per barrel of heater charge and operating temperature of as much as 1,200° F. These conditions are limited only by the optimum economics of higher investment weighted against the additional revenues realized from more valuable hydrocarbon products. The operation is similar to the mild hydropyrolysis case except the separated vapor product, rich in hydrogen gas, may be cooled and directed to a separate high-pressure drum whereby the enriched hydrogen gas stream, along with the make-up hydrogen gas, is compressed back to the flasher drum. The liquid portion of the separator, depleted of light hydrocarbons and gases may be sent back directly to the coker fractionator. This technique is well known to those skilled in refinery operation and may well be different in every case to suit each refinery's overall capacity and configuration.

Residence time is controlled by the level controller on the flasher drum which is directly proportional to the degree of gasoline and lighter products conversion. Higher conversion results to more vaporization and hence, more hydrocarbon yield; but produces more tarry to pitch-like material. The drum is provided with a controllable level of between 1.0 to 10.0 minutes residence time and should be started at the 2.0 minutes mark and hence raised to manageable limit for optimum hydrocarbon yield. For the case of moderate hydropyrolysis, the residence time is expressed in terms of hydrogen gas contact time which could translate to a much higher liquid residence time. Coking in the flasher drum for this case is not a problem because the results of more conversion is the break-up of heavier tarry materials.

In the aforementioned specifications, a detailed account of all interacting variables of temperature, pressure, injection gases, % vaporization and recycle ratio show without doubt, the impediments of said variables to enhanced yields can be minimized. Further, the process is flexible enough as to impart the same desired properties in the green coke. Aside from the capability of this invention to operate at higher outlet temperature in the coke drum of at least 15° F. above the prior art, the controlled injection or gases from the flasher drum creates a reduction in hydrocarbon partial pressure in the coke drum vapor space. Moreover, this invention provides the opportunity for the liquid portion of the recycle material to vaporize readily in the flasher drum as well as in the coke drum, effectively minimizing coke production due to the recycle material.

For illustration therefore, this novel delayed coking process is hence equivalent to at least 15° F. higher coke drum outlet temperature and lower equivalent pressure than prior art values with a TFR equivalence of close to 1.00. The net effect of these advantages to product yields is clearly shown in the following comparison.

| | Weight % of Fresh Feed | | | |
|---|---|---|---|---|
| | This Invention | | | Prior Art |
| | Flasher Drum Yield | Coke Drum Yield | Overall Yield | Overall Yield |
| Gases | 2.20 | 6.20 | 8.4 | 9.03 |
| $C_5$+ | 30.97 | 40.23 | 71.2 | 61.97 |
| Coke | — | 20.40 | 20.4 | 29.0 |
| Total | 33.17 | 66.83 | 100.0 | 100.00 |

For added flexibility in design and operation, the flasher drum vapor may be sent also to a vacuum unit tower system, an atmosheric crude distillation tower system or any tower system which would accomodate said vapors. Such tower(s) may be a modified existing or a new tower system(s) specifically designed for this invention.

DESCRIPTION OF THE PREFERRED EMBODIMENTS

Figure 1:
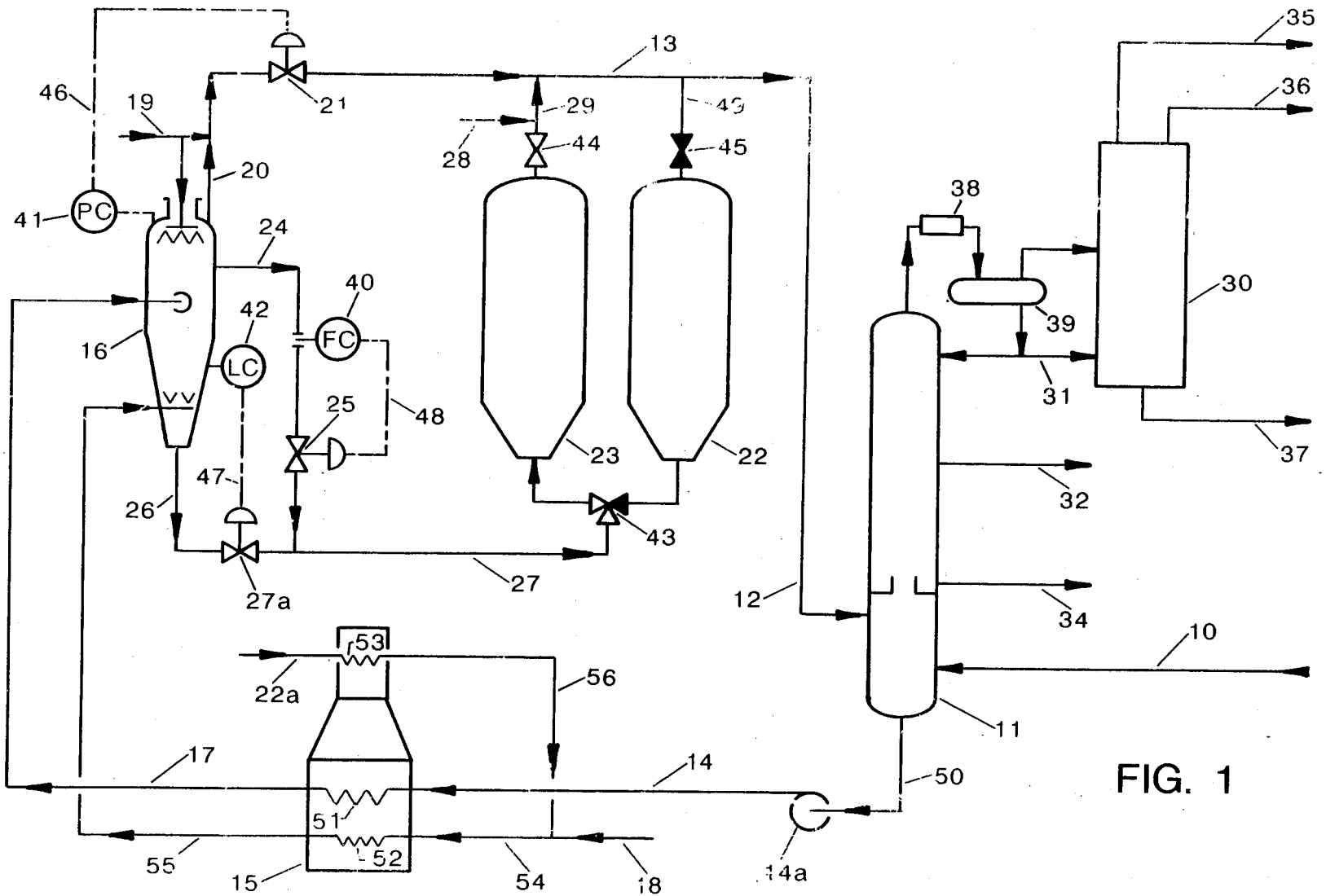
FIG. 1 is a schematic flow diagram of a representative embodiment of this invention.

Referring now to FIG. 1, a fractionation column is indicated at 11 which is designed to separate the distillate products into the desired boiling range cuts and purity. The column includes a partial condenser 38 which removes heat by air or water and therefore condenses the lowest boiling range liquid cut. Uncondensed vapor and gases are separated in receiver 39. The liquid from receiver 39 may be used as reflux to the column or transported to the gas plant 30 where it is used in the processing of gases and light liquid hydrocarbons for more separation of desired products at higher purities.

A coker heater is indicated at 15 and which includes a primary heater coil 51, a steam superheater coil 53 and a secondary heater coil 52.

A flasher drum is indicated at 16 where the material from the heater is allowed to separate into liquid and gaseous components. Pressure is maintained in the flasher drum by a control loop which includes a pressure controller PC 41, pressure control valve 21 and controller transmission line indicated by 46. A liquid level is maintained in the flasher drum by another control loop which includes level controller LC 42, level control valve **27*a* and controller transmission line 47. Another control loop is provided to use part of the vapor in the flash drum as injection vapor as described below and includes a flow controller FC 40, flow control valve 25 and controller transmission line 48**.

Two coke drums are indicated at 22 and 23 which are operated such that one is undergoing coking reactions while the other is being decoked or emptied of its solid coke product. Three-way valve 43 is provided to divert the liquid from flasher drum 16 to the drum which is coking. Valves 44 and 45 are provided to isolate the open drum from the other drum. Darkened valves indicate closed, and as illustrated, liquid is being directed by three-way valve 43 to coke drum 23 and coke drum 22 is isolated by the closed valve 45.

A pump **14*a*** is provided as the prime mover of the column bottoms liquid to coking system. All necessary pipelines between equipment are indicated and numbered, the arrows showing direction of flow.

A typical petroleum residue (fresh feed), such as the unvaporized portion of a petroleum crude processed in a vacuum distillation column is introduced directly to column 11 at 600° to 700° F., or preheated to such temperature in the coker unit itself and hence fed through pipeline 10 into the bottom of fractionation column 11. Gases, net hydrocarbon products and the recycle material produced from the coking process is introduced into column 11 through pipeline 12 at a point above the bottom liquid level.

The separation trays below the first gas oil product draw tray is operated such that the amount of recycle material condensed is approximately 0.2 to 0.4 times the amount of fresh feed and combines with the fresh feed in the bottom of column 11 to establish a total feed ratio (TFR) of 1.20 to 1.40, the volumetric ratio of heater charge and fresh feed. The heater charge is taken from the bottom of the fractionation column 11 through pipeline 50 and transported to the coker heater 15 through line 14 at approximately 650° F. by pump **14*a***.

The combined mass in line 14 is heated in the primary heater coil 51 and undergoes vaporization and thermal decomposition and to a negligible extent, the polymerization of variously formed hydrocarbon radicals, to an outlet or heater effluent temperature of at least 920° F. The combined mass from heater 15 is then pressured to flasher drum 16 via pipeline 17 where its vapor and liquid portions are separated. Saturated steam is fed through pipeline **22*a* and superheated by heater coil 53. Hydrogen rich gas and fuel gas are introduced by a separate pipeline 18, combined with the superheated steam in pipeline 56, heated in the coker heater coil 52 and transported through pipeline 55 to flasher drum 16** to furnish the needed heat for thermal reactions and vaporization. Hydrogen in such gases helps in minimizing hydrocarbons radical polymerization by the process of mild hydropyrolysis.

Quench oil from the coker light distillate product is provided to flasher drum 16 by pipeline 19 for cooling of the vapor portion of the flasher effluent to 840° F. and not less than 780° F. prior to leaving the overhead vapor pipeline 20. A control loop, including control valve 21 and pressure controller 41 is provided in the overhead vapor line 20 to control pressure in flasher drum 16 which, in effect, controls the degree of vaporization, gasoline conversion and subsequent hydrocarbon yield in the coke drums 22 or 23. The actual pressure is established during operation when all interacting variables are known, but for traditional delayed coking operations, a pressure range of 100 to 250 psig is expected. For a moderate case of hydropyrolysis, the pressure can be as high as 1,000 psig- limited only by the degree of hydrogenation designed for the process.

A portion of the vapor separated in flasher drum 16 is used as injection vapor through pipeline 24 to coke drums 22 or 23 to control the hydrocarbon partial pressure, to control the VCM content or quality and hardness of the coke product and to effect the reduction of coke yield in the coke drum. The rate of injection vapor is controlled by a control loop which includes flow controller FC 40, flow control valve 25 and controller transmission line 48.

Liquid bottoms from flasher drum 16 is transported by pipeline 26 through level control valve **27*a* and flashes to a two-phase flow condition immediately downstream of valve 27*a* before mixing with the injection vapor in pipeline 24 prior to entering the coke drum 22 or 23. Level controller LC 42 controls the residence time of the highly reactive liquid undergoing simultaneous thermal cracking, polycyclic aromatic polymerization, hydropyrolysis and vaporization by operating level control valve 27*a* through transmission line 47. The liquid bottoms from flasher drum 16 are mixed in pipe line 27 with the injection vapor in pipeline 24 downstream of the level control valve 27*a*, and enters one of the coke drums 22 or 23 through threeway valve 43 while the offstream coke drum 22 or 23 is completing its decoking cycle. Quench oil is further provided in pipeline 28 for cooling the vapor products in coke drums 22 or 23 to no less than 780° F. nor more than 800° F. and the quenched vapor products are transported by pipeline 29 or 49 through valve 44 or 45 for mixing in pipeline 13 with the overhead vapor in pipeline 20 from flasher drum 16, and subsequent transport in line 12 to the bottom section of fractionator column 11. Coke eventually builds up in the onstream coke drum 22 or 23 to its maximum level at the end of the prescribed coking cycle, preferably 24 hours at which time valve 43 is switched to the empty coke drum 22 or 23 and the valve 44 or 45** from filled coke drum is closed.

The vapor effluent from flasher drum 16 in pipeline 20 and the vapor effluent from the coke drum overhead in pipeline 29 are combined in pipeline 13 and transported to fractionation column 11, which produces by condensation or fractionation, the desired quantity of recycle equivalent to approximately 1.30 TFR and combines with the fresh feed stock in the bottom of column 11. All desired hydrocarbon products, typically consisting of heavy gas oil, light gas oil, naphtha, gasoline, propanes and butanes, and fuel gases are fractionated and separated in fractionation column 11, condenser 38, receiver 39 and gas plant 30, and are delivered downstream via pipelines 34 (for heavy gas oil) 32 (for light gas oil) directly from column 11 and via pipelines 35 (for Fuel gases), 36 (for propanes and butanes), 37 (for gasoline and naphtha) from gas plant 30.

The term "prevailing", used in the claims as "prevailing temperature" or "prevailing pressure", is to mean: the actual temperature or actual pressure of a fluid system at a given location some distance away from the point of measurement or selected set point. This is to specify in more exacting terms that the selected temperature/pressure has a differential numerical value when compared with the prevailing temperature/pressure due to temperature/pressure drop or rise. For example, if the selected temperature of the heater effluent is 935° F., fluid temperature drops to 920° F. due to endothermic reactions in the transfer line to the flasher drum. In this case, the prevailing temperature at the flasher drum when flashed is 920° F. Under the same process and additional vaporization of hydrocarbons, the prevailing temperature of the flasher drum liquid bottoms can drop to 900° F. Or it can also rise to 950° F. if excess sensible heat, over what is required for thermal reactions and vaporization is available in the heating gases. Similarly, if the flasher drum pressure is set at, or selected at 135 psig, the prevailing pressure at the flasher drum bottom can be 150 psig. The differential value of 15 psi can be attributed to the elevation head created by the liquid level some 40 feet above the drum bottom. Prevailing temperature/pressure is commonly used by those skilled in the art to clearly and definitely describe the actual operating conditions expected of a fluid system at a given location.

Although the preferred embodiment of the invention has been described above, it is to be understood that modifications can be made therein and thereto without departing from the spirit and scope of the invention. All such modifications are intended to be included within the scope of the present invention, which is to be limited only by the claims which follows.

What I claim is:

1. In a process for delayed coking of heavy petroleum residue feedstock within a coker heater, a coke drum and a fractionator, wherein the feedstock and recycle material are heated in said heater and then passed to said coke drum to produce coke and overhead vapors, wherein said vapors are fed into a bottom primary section of said fractionator, wherein a heavy gas oil product is fractionated and withdrawn from a secondary section of said fractionator, wherein a light gas oil and other lighter distillates products are fractionated and withdrawn from the succeeding sections of said fractionator, wherein a naphtha and gaseous constituents are fractionated and withdrawn from the top section of said fractionator, wherein a selected portion of said coke drum overhead vapors is condensed as heavy recycle in said primary section of said fractionator and combined with the preheated but unvaporized feedstock, wherein a selected quantity ratio of said heavy recycle and said feedstock is charged to said coker heater, wherein a flow rate of said combined heavy recycle and feedstock is adjusted to operate said coker heater at a selected inlet cold oil velocity, wherein said combined heavy recycle and feedstock is heated to thermal cracking temperature in said coker heater, wherein said temperature is increased further to effect more thermal reactions and additional vaporization of hydrocarbons, wherein a final temperature of the heater effluent is selected to minimize excessive coke deposition in the heater tubes, and wherein said heater effluent of vapor and liquid constituents consists solely of the products of thermal reactions and vaporization of said combined feedstock and heavy recycle at its prevailing pressure and temperature, the improvement comprising:

(a) Feeding and flashing said heater effluent at its prevailing temperature into a flasher drum wherein its vapor and liquid constituents are separated at a selected pressure, and wherein the separated liquid constituent is soaked at a selected residence time to allow further thermal reactions and vaporization in said liquid;

(b) Injecting selected flow rates of heated hydrogen-rich gas and one or more gases selected from the group of steam, light hydrocarbons and refinery fuel gas at a selected temperature into said separated liquid constituent to provide a stripping medium and to provide additional heat for thermal reactions, additional vaporization of hydrocarbons, and minimization of polycyclic aromatic polymerization of bimolecular radicals; all of said heater effluent flashing, said effluent liquid constituent of thermal reactors, and combining of effluent vapor constituent with the vapor products of thermal reactions and vaporization from the liquid therein being performed in said flasher drum to produce a resultant liquid bottoms with more thermally reacted heavy hydrocarbons than said heater effluent liquid; and to produce a resultant vapor with more gaseous constituents, more thermally converted light hydrocarbons, and more vaporized hydrocarbons than said heater effluent vapor;

(c) Injecting a selected flow rate of said resultant vapor at selected flasher drum pressure into the feed line of said coke drum at prevailing coke drum inlet pressure, in order to: (i) reduce the partial pressure of hydrocarbons in the coke drum; (ii) minimize the coke deposition in the coke drum feed line; (iii) control the hardness and quality of the coke product; (iv) control the coke drum overhead vapor temperature;

(d) Flashing to vapor and liquid constituents said resultant liquid bottoms at its prevailing temperature and at prevailing flasher drum pressure into the feed line of said coke drum at prevailing coke drum inlet pressure;

(e) Combining said flashed resultant liquid bottom with said injection vapor in said coke drum feed line at prevailing coke drum inlet pressure;

(f) Feeding said combination of flashed resultant liquid bottoms and injection vapor from the coke drum feed line into said coke drum; and (g) Removing the remainder of said resultant vapor at its prevailing temperature and at selected flasher drum pressure for further processing.

2. In a process for delayed coking of heavy petroleum residue feedstock within a coker heater, a coke drum and a fractionator, wherein the feedstock and recycle material are heated in said heater and then passed to said coker drum to produce coke and overhead vapors, wherein said vapors are fed into a bottom primary section of said fractionator, wherein a heavy gas oil product is fractionated and withdrawn from a secondary section of said fractionator, wherein a light gas oil and other lighter distillates products are fractionated and withdrawn from the succeeding sections of said fractionator, wherein a naphtha and gaseous constituents are fractionated and withdrawn from the top section of said fractionator, wherein a selected portion of said coke drum overhead vapors is condensed as heavy recycle in said primary section of said fractionator and combined with the preheated but unvaporized feedstock, wherein a selected quantity ratio of said heavy recycle and said feedstock is charged to said coker heater, wherein a flow rate of said combined heavy recycle and feedstock is adjusted to operate said coker heater at a selected inlet cold oil velocity, wherein said combined heavy recycle and feedstock is heated to thermal cracking temperature in said coker heater, wherein said temperature is increased further to effect more thermal reactions and additional vaporization of hydrocarbons, wherein a final temperature of the heater effluent is selected to minimize excessive coke deposition in the heater tubes, and wherein said heater effluent of vapor and liquid constituents consists solely of the products of thermal reactions and vaporization of said combined feedstock and heavy recycle at its prevailing pressure and temperature, the improvement comprising:

(a) Feeding and flashing said heater effluent at its prevailing temperature into a flasher drum wherein its vapor and liquid constituents are separated at a selected pressure, and wherein the separated liquid constituent is soaked at a selected residence time to allow further thermal reactions and vaporization in said liquid;

(b) Injecting selected flow rates of heated hydrogen-rich gas and one or more gases selected from the group of steam, light hydrocarbons and refinery fuel gas at a selected temperature into said separated liquid constituent to provide a stripping medium and to provide additional heat for thermal reactions, additional vaporization of hydrocarbons, and minimization of polycyclic aromatic polymerization of bimolecular radicals; all said heater effluent flashing, said effluent liquid constituent reacting operations, and combining of effluent vapor constituent with the vapor products of thermal reactions and vaporization from the liquid therein being performed in said flasher drum to produce a resultant liquid bottoms with more thermally reacted heavy hydrocarbons than said heater effluent liquid; and to produce a resultant vapor with more gaseous constituents, more converted light hydrocarbons, and more vaporized hydrocarbons than said heater effluent vapor;

(c) Flashing to vapor and liquid constituents said resultant liquid bottoms at its prevailing temperature and at prevailing flasher drum pressure into the feed line of said coke drum at prevailing coke drum inlet pressure;

(d) Feeding said flashed resultant liquid bottoms from the coke drum feed line into said coke drum; and (e) Removing said resultant vapor at its prevailing temperature and at selected flasher drum pressure for further processing.

3. In a process for delayed coking of heavy petroleum residue feedstock within a coker heater, a coke drum and a fractionator, wherein the feedstock and recycle material are heated in said heater and then passed to said coke drum to produce coke and overhead vapors, wherein said vapors are fed into a bottom primary section of said fractionator, wherein a heavy gas oil product is fractionated and withdrawn from a secondary section of said fractionator, wherein a light gas oil and other lighter distillates products are fractionated and withdrawn from the succeeding sections of said fractionator, wherein a naphtha and gaseous constituents are fractionated and withdrawn from the top section of said fractionator, wherein a selected portion of said coke drum overhead vapors is condensed as heavy recycle in said primary section of said fractionator and combined with the preheated but unvaporized feedstock, wherein a selected quantity ratio of said heavy recycle and said feedstock is charged to said coker heater, wherein a flow rate of said combined heavy recycle and feedstock is adjusted to operate said coker heater at a selected inlet cold oil velocity, wherein said combined heavy recycle and feedstock is heated to thermal cracking temperature in said coker heater, wherein a final selected temperature of the heater effluent is increased further to effect more thermal reactions and additional vaporization of hydrocarbons, and wherein said heater effluent of vapor and liquid constituents consists solely of the products of thermal reactions and vaporization of said combined feedstock and heavy recycle at its prevailing pressure and temperature, the improvement comprising;

(a) Feeding and flashing said heater effluent at its prevailing temperature into a flasher drum wherein its vapor and liquid constituents are separated at a selected pressure high enough to effect increasing the heater effluent temperature to at least 15° F. higher than the maximum temperature achievable under subcritical pressure of about 50 psig without effecting excessive coke deposition in the heater tubes, and wherein the separated liquid constituent is soaked at a selected residence time to produce a resultant liquid bottoms with more thermally reacted heavy hydrocarbons than said heater effluent liquid; and to produce a resultant vapor with more gaseous constituents, more thermally converted light hydrocarbons, and more vaporized hydrocarbons than said heater effluent vapor;

(b) Combining therein, as the equivalent of said resultant vapor from (a), the flasher drum vapor products of thermal reactions and vaporization with the heater effluent vapor constituent;

(c) Injecting a selected flow rate of said resultant vapor at selected flasher drum pressure into the feed line of said coke drum at prevailing coke drum inlet pressure, in order to: (i) minimize coke deposition in the coke drum feed line; (ii) control the hardness and quality of the coke product; (iii) control the coke drum overhead vapor temperature;

(d) Flashing to vapor and liquid constituents said resultant liquid bottoms at its prevailing temperature and at prevailing flasher drum pressure into the feed line of said coke drum at prevailing coke drum inlet pressure;

(e) Combining said flashed resultant liquid bottoms with said injection vapor in said coke drum feed line at prevailing coke drum inlet pressure;

(f) Feeding said combination of flashed resultant liquid bottoms and injection vapor from the coke drum feed line into said coke drum; and (g) Removing the remainder of said resultant vapor at its prevailing temperature and at selected flasher drum pressure for further processing.

4. The process of claim 1 or claim 2 or claim 3 wherein said heater effluent is flashed at a selected pressure of 50 psig to 350 psig and a selected heater effluent temperature of 900° F. to 970° F., and wherein the separated liquid constituent is soaked in said flasher drum at a selected residence time of 1 to 10 minutes to allow controlled thermal reactions and vaporization in said liquid.

5. The process of claim 1 or claim 2 wherein the flow rate of injection of said hydrogen-rich gas is at least 5.6 standard cubic feet per barrel of heater charge; the flow rate of injection of steam is at least 3.6 pounds per barrel of heater charge; and the flow rate of injection of said refinery fuel gas or light hydrocarbons is at least 55.3 standard cubic feet per barrel of heater charge; all of said hydrogen-rich gas, steam, light hydrocarbons or refinery fuel gas being heated to a selected temperature of 970° F. to 1,150° F. prior to injection; and all said flow rates being limited by one or more restrictions from the group of: (a) premature coking in said flasher drum; (b) maximum capacity of said coker fractionator; and (c) maximum operating temperature of said flasher drum and said coke drums.

6. The process of claim 1 or claim 3 wherein the maximum flow rate of said injection vapor is selected to effect a volatile carbonaceous matter content of no less than four percent in the coke product.

7. The process of claim 1 or claim 2 wherein said heater effluent at its prevailing temperature is flashed at a total selected pressure sufficient to maintain a hydrogen partial pressure of up to 1,200 psig in said flasher drum at the separated liquid constituent is soaked in said flasher drum for at least five minutes residence time to effect the moderate hydropyrolysis of said liquid; the flow rate of said heated hydrogen-rich gas injection being selected, and the residence time of said liquid being limited, to maintain the desired extent of hydropyrolysis reactions.

8. The process of claim 1 or claim 2 or claim 3 wherein a selected flow rate of liquid light gas oil is sprayed into said resultant flasher drum vapor to stop the continuation of coking reaction in said vapor before leaving said flasher drum, and wherein a selected flow rate of liquid light gas oil is further sprayed into the ensued partially quenched vapors in the flasher drum overhead vapor line to fully quench and control its temperature between 780° F. and 840° F.

9. The process of claim 1 or claim 2 or claim 3 wherein said removed resultant flasher drum vapor at its prevailing temperature and at selected flasher drum pressure is processed to recover the hydrocarbons by one or more methods selected from the group of: (a) combining with the coke drum vapor overhead products a prevailing pressure for processing in said coker fractionator; (b) feeding into an existing atmospheric crude distillation tower system; (c) feeding into an existing vacuum reduced crude distillation tower system; and (d) feeding into a separate and new or existing fractionating tower system other than (a), (b), and (c) specifically designed to process said resultant vapor.

10. The process of claim 1 or claim 2 or claim 3 wherein the flow rate of said resultant flasher drum vapor being removed is adapted to allow flexibility in adjustment of coker heater effluent temperature, heater tube inlet cold oil velocity and total feed ratio to effect the greatest conversion to hydrocarbon product and minimize coke production.

11. The process of claim 10 in which the heater is charged at an equivalent total feed ratio (TFR) of 1.20 to 1.40, an inlet cold oil velocity (COV) of 6.0 to 8.0 feet per second, and heated to a selected effluent temperature of between 935° F. to 950° F. for the case of heavy paraffinic residues, or between 950° F. for the case of light paraffinic stocks as reduced crude and aromatic stocks as cracked petroleum residues.

12. The process of claim 1 or claim 2 or claim 3 in which the heavy petroleum residue is selected from the group of atmospheric distillation residue, vacuum distillation residue, catalytic cracker decant oil, ethylene pyrolysis residue, asphalt, heavy fuel oil, thermal cracker residue, coal tar pitch, tar sand bitumen and mixture thereof, producing coke selected from the group of fuel grade coke, aluminum electrolytic anode grade coke, premium coke, and fluid coke having a high volatile carbonaceous matter.

* * * * *